US007418917B2

(12) United States Patent
Bach

(10) Patent No.: US 7,418,917 B2
(45) Date of Patent: Sep. 2, 2008

(54) HIDDEN MARINE WINDSHIELD MOUNTING SYSTEM AND METHOD

(76) Inventor: Darren Ashley Bach, 7993 Progress Way, Delta (CA) V4G 1A3

( * ) Notice: Subject to any disclaimer, the term of this patent is extended or adjusted under 35 U.S.C. 154(b) by 558 days.

(21) Appl. No.: 11/155,942

(22) Filed: Aug. 29, 2005

(65) Prior Publication Data

US 2008/0156247 A1 Jul. 3, 2008

(51) Int. Cl.
*B63B 17/00* (2006.01)

(52) U.S. Cl. ..... 114/361; 296/84.1; 296/96.12

(58) Field of Classification Search ..... 114/361; 296/84.1, 96.12, 96.13
See application file for complete search history.

(56) References Cited

U.S. PATENT DOCUMENTS 5,327,764 A * 7/1994 Weykamp et al. ..... 72/296
5,343,824 A * 9/1994 Floyd ..... 114/361
6,158,372 A * 12/2000 Erskine ..... 114/177
6,875,496 B2 * 4/2005 Roosen et al. ..... 428/194

* cited by examiner

*Primary Examiner*—Sherman Basinger

(57) ABSTRACT

A hidden marine windshield mounting system and method, utilizing a cooperative pair of elongated base members, longitudinally extending around the front of and fastened to a marine vessel deck. The two elongated base members cooperatively interlock with one another to form a single windshield mounting base unit, having a substantially vertically erect windshield receiving area for adhesion of most usually, curved windshield tempered glass. Mounted onto the top of the curved windshield glass is an elongated trim member, which may come into contact at its ends, with the ends of the base member pair. The base member pair can be forcibly separable from one another after stretch forming for assembly, installation and for glass replacement.

23 Claims, 9 Drawing Sheets

HIDDEN MARINE WINDSHIELD MOUNTING SYSTEM AND METHOD

TECHNICAL FIELD

The invention relates to a mounting system for marine windshields and method of manufacture, and more specifically to a hidden mounting system utilizes an interlocking pair of extrusions, which are adjustable and separable.

BACKGROUND OF THE INVENTION

Mounting, trimming or finishing the edges of marine windshields has become more complex over the years as the windshield shapes have progressed from simple rectangular panes to complexly curved and obliquely oriented windshields, some of which are segmented to allow access to a forward seating area.

The most common approach currently in use is to employ a metal extrusion which is stretch formed on a die set to the curved shape of the edge of the windshield glass to be mounted. Usually the mounting and edge trimming extrusions are formed from aluminum and often have a windshield receiving longitudinally extending channel. A gasket, such as a vinyl or thermoplastic gasket, is mounted between the windshield channel in the extrusion and the glass so as to seal and cushion the windshield edge assembly.

Typical marine windshield mounting extrusions that extend along the bottom edge of the windshield for mounting the windshield to the deck are the following patented mounting assemblies, as are set forth in U.S. Pat. Nos. 6,800,160; 6,647,914; 5,601,050; 5,269,250; 4,815,410; 4,750,449; 3,810,267; 3,654,648; 3,021,535 and 3,016,548.

Accordingly, it is an object of the present invention to provide a windshield mounting system and method of manufacturing and attaching the same, which is well suited for use as a mounting assembly for curved boat windshields.

Another object of the present invention is to provide a windshield mounting system in which can be interconnected together during stretch forming of the windshield mounting system into a curved configuration and separable for suitable assembly and mounting on a marine vessel deck.

Another object of the present invention is to provide a windshield mounting system having improved aesthetic value.

A further object is to provide a windshield mounting system where mounting by boat manufactures is made easier.

Still a further object of the present invention is to provide a windshield mounting assembly that can be adjustable, fore or aft as may be required after the marine vessel has been in service for a period.

The hidden marine windshield mounting system and method of the present invention has other objects and features of advantage which will become apparent from and are set forth in more detail in, the accompanying drawings and following details.

DISCLOSURE OF THE INVENTION

The hidden marine windshield mounting system and method of the present invention is designed to be stretch or die formed so as to fit along the frontal area of a marine vessel deck, and comprises briefly, an elongated base member, longitudinally extending along the front and somewhat along the sides of the vessel deck and including a windshield mounting rail. The windshield mounting rail includes an elongated windshield glass adhesion area. The windshield assembly usually includes a longitudinally extending top windshield edge receiving structure applied to complete the windshield assembly. These windshield structural members are typically made using suitable aluminum alloy extrusions.

The base member is fastened to the curved deck and a windshield mounting rail longitudinally inserted into the base member. The base member has an elongated V-shaped profile which is tipped onto one element of it's shape, where this lower element is fasten to the deck and where the top overhanging element includes a downward protruding lip along and under its upper edge. The windshield mounting rail profile has a lower wedge shaped element to fit within the base member. The lower protruding lip engages a recess near the mid section of the windshield mounting rail, to lockably engage the windshield mounting rail within the first base profile. The windshield mounting rail includes as an integral part of the member, a windshield receiving flange, vertically appended to the wedge shaped lower element.

The two base members of the present invention will allow for adjustment of the windshield sections towards the center of the boat when the system is installed or in use. This is particularly required where there is an access door through the center area of the windshield assembly to the front area of the boat, as is common in many modern boat designs. This type of boat design compromises the boat's structure and often causes the boat to settle, or to cause "shoe boxing" after time. The present invention can be readily adjusted towards center, as may be required to alleviate this problem.

Also, the area where the windshield system is installed on certain boat designs, a step in the deck, or top of the hull area may be desirable. This step would be below the glass and would be added to allow for slight inconsistencies in the deck or hull and or the glass, and gives a cleaner visual line at the bottom of the glass.

In a second aspect of the present invention, the base member and the windshield mounting rail are cooperatively formed by first snapping the members together and then stretch forming them as a unit. The extrusions shape of the first and the windshield mounting rail and extrusions area thickness as well as the stretch forming dies used in the stretch forming process hold the extrusions in cooperative engagement, while applying a concerted surface pressure during stretch forming, this allows the base member and the windshield mounting rail to be separated from one another after the stretch forming.

As well, these mating mounting extrusions may be of different aluminum alloys to assist in the forming and subsequent correspondence of the two extrusion elements. As an example the base member can be a 6063 T1 extrusion while the windshield mounting rail can be a 6063 T5 extrusion.

The profile configuration of the two base elements being a wide point to small point of a wedge shape, inherently allows control of deformation during the forming process and provides an adjustable control surface with tight tolerance when cooperatively formed together and when matching of replacement parts.

As well, it has been found that the profile design of both the base member and the windshield mounting rail is inherently adaptive to the process of extruding of the longitudinal elements.

Also, it is intended that the base member and the windshield mounting rail be coated by anodizing or other applied coating to improve durability as well as the releaseability from one another. Releaseability is required after the stretch forming process for completion of the windshield manufacturing process and when mounting the system on a marine vessel deck, and again for purposes of replacing, or adjusting the windshield assembly after the system has been in service on the marine vessel.

In a third aspect of present invention, which is the manufacturability of the system, an adhesive application process is used to fix the glass to the windshield mounting rail's vertical element. This adhesive application process may be of two parts. The application of a double backed strip adhesive along with a liquid or gelled consistency, urethane type glue, applied alongside the strip adhesive. This process will allow the windshield glass to be aligned and "set" while the glue sets up over a longer period.

Another similar application would be the use of a plurality of parallel adhesive strips that are separate by a distance to allow the application of glue applied in-between the adhesive strips. A further mode of application would be the use of a single wider adhesive strip with a series of spaced apertures, where glue is placed within the apertures along the strip adhesive.

Yet a further glue application method that resembles the opposite of the previous method, uses adhesive tabs along with a urethane glue ribbon or band. Here the tabs are evenly spaced along the bottom of the glass, or onto the windshield mounting rail's glue receiving area, the glass and windshield mounting rail are then "set" together.

One other method is the application of a heat sensitive glue, where the glue is heated upon application of the glass to rapidly set the glue. This type of glue could be used along with the above application methods, or as a singular application method. These steps will reduce the time that the windshield assembling process takes by allowing the assembly to be moved along before the glue has set-up.

The processing of applying glue and "setting" the windshield glass to the windshield mounting rail requires another crucial step, which is that of alignment, that is to precisely aligning the glass and the windshield mounting rail as the glue or adhesive is "set". This process includes the application of a few small markers applied to the glass. The markers can be small dots or thin X marks on the glass. The windshield mounting rail extrusion requires home marker points which are placed onto the windshield mounting rail glue adhesion area and these home marker points coincide exactly to the glass markers, so the glass and the windshield mounting rail are precisely "set" together.

The present invention may include a thin ceramic coating applied to the lower area of the glass during its tempering process. The ceramic coating would then have the previously mentioned alignment markers therein. Of course, the alignment marks would actually be clear dots or X marks within the ceramic coating. The ceramic coating is preferably black, although other colors can be used, but it is important to use the same color as the adhesive used, so the adhesive will hide the markers. The ceramic coating can also be designed to improve the aesthetic value of the windshield assembly as desired.

Also, the glass can be tinted or "smoked" as may be desired to enhance the overall visual appearance of the windshield assembly, while acting in effect to make the adhesive and the alignment marks to become virtually invisible.

BRIEF DESCRIPTION OF THE DRAWINGS

Advantages of the present invention will become more fully appreciated as the same becomes better understood when considered in conjunction with the following detailed description of an illustrative embodiment and accompanying drawings, in which like reference characters designate the same or similar parts throughout the several views, and wherein.

DETAILED DESCRIPTION OF THE PREFERRED EMBODIMENTS

Figure 1:
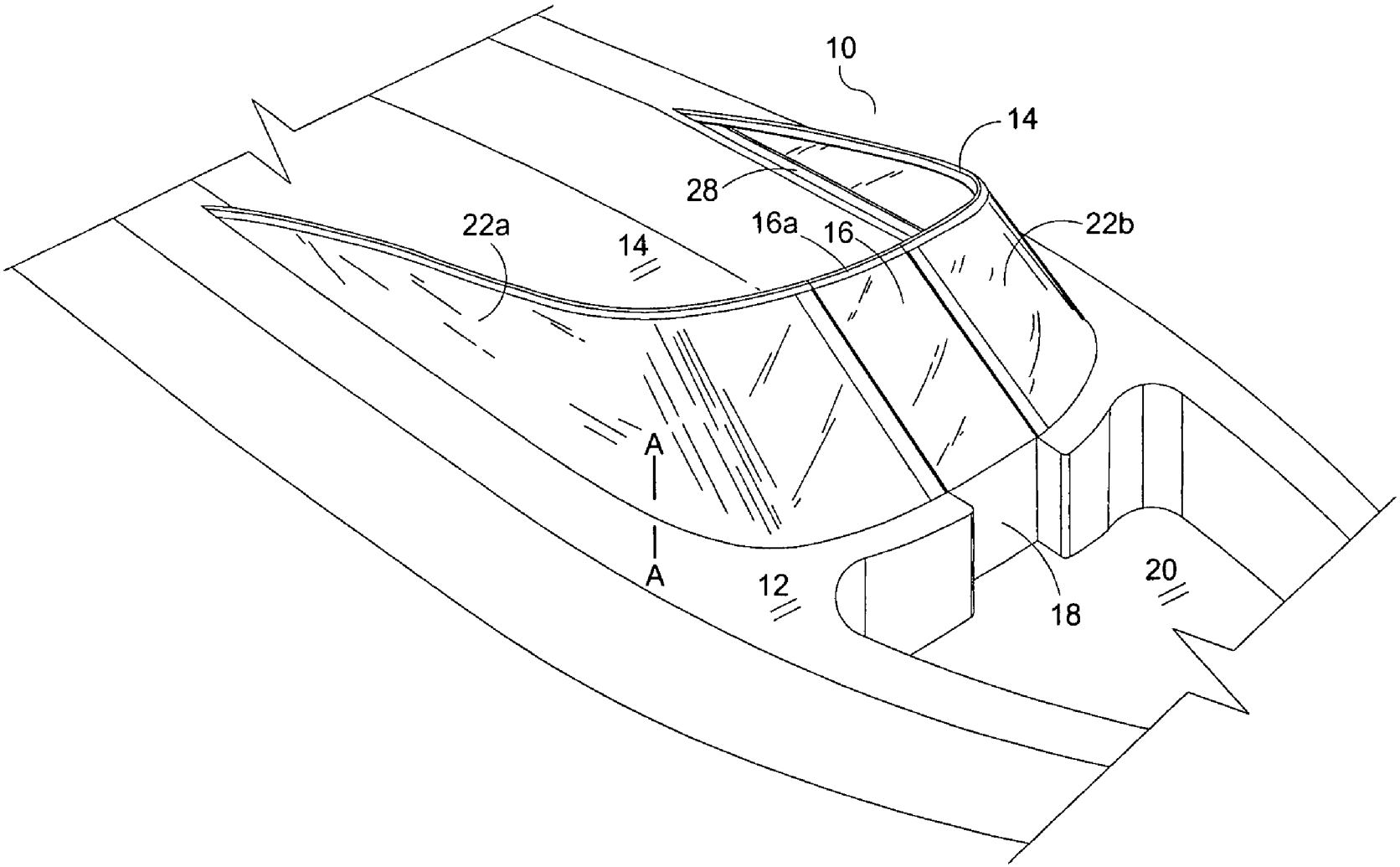
FIG. 1 is a perspective view of the preferred embodiment showing the invention mounted onto a boat deck.

The Hidden marine windshield mounting system is generally referred to as 10 as shown in a perspective view in FIG. 1. A boat is shown in partial view where a deck 12 has windshield system 10 mounted thereon. Windshield 10 is dramatically curved and swept back along the sides of the cockpit area 14.

Windshield 10 is shown in 3 sections where the center windshield section 16 is attached to a door 18, where door 18 allows access to the front seating area 20. Windshield 10 includes curved glass 22, with two peripheral sections 22*a* and 22*b*. On top of glass sections 16, 22*a* and 22*b* are longitudinally extending top windshield edge receiving structures 16*a*, 24*a* and 24*b*.

Figure 2:
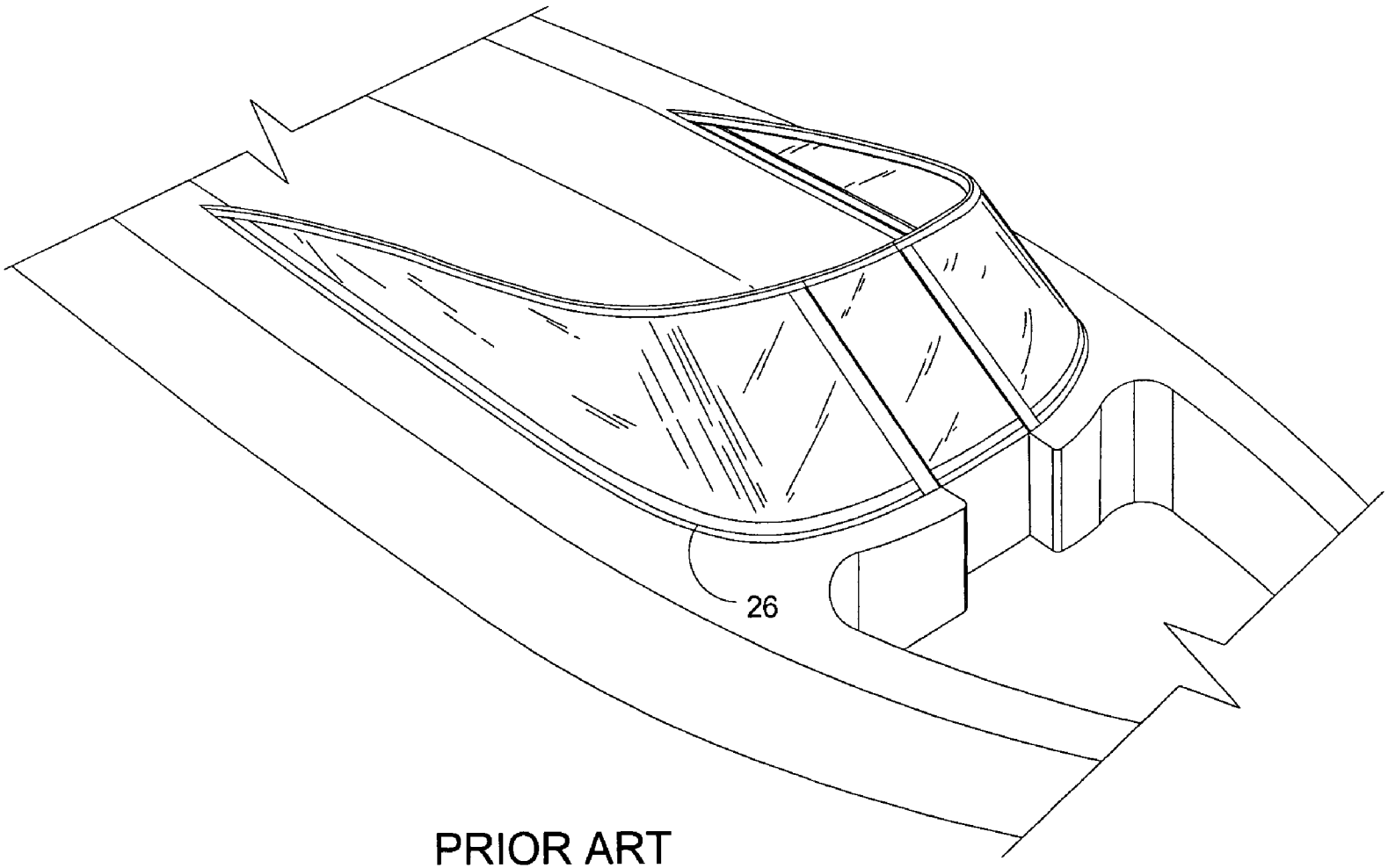
FIG. 2 PRIOR ART
FIG. 2 is a perspective view of prior art mounting of a windshield onto a boat deck.

As seen in FIG. 2 a boat is shown in partial view where a prior art windshield mounting is shown having a visible exterior mounting base 26.

Figure 3:
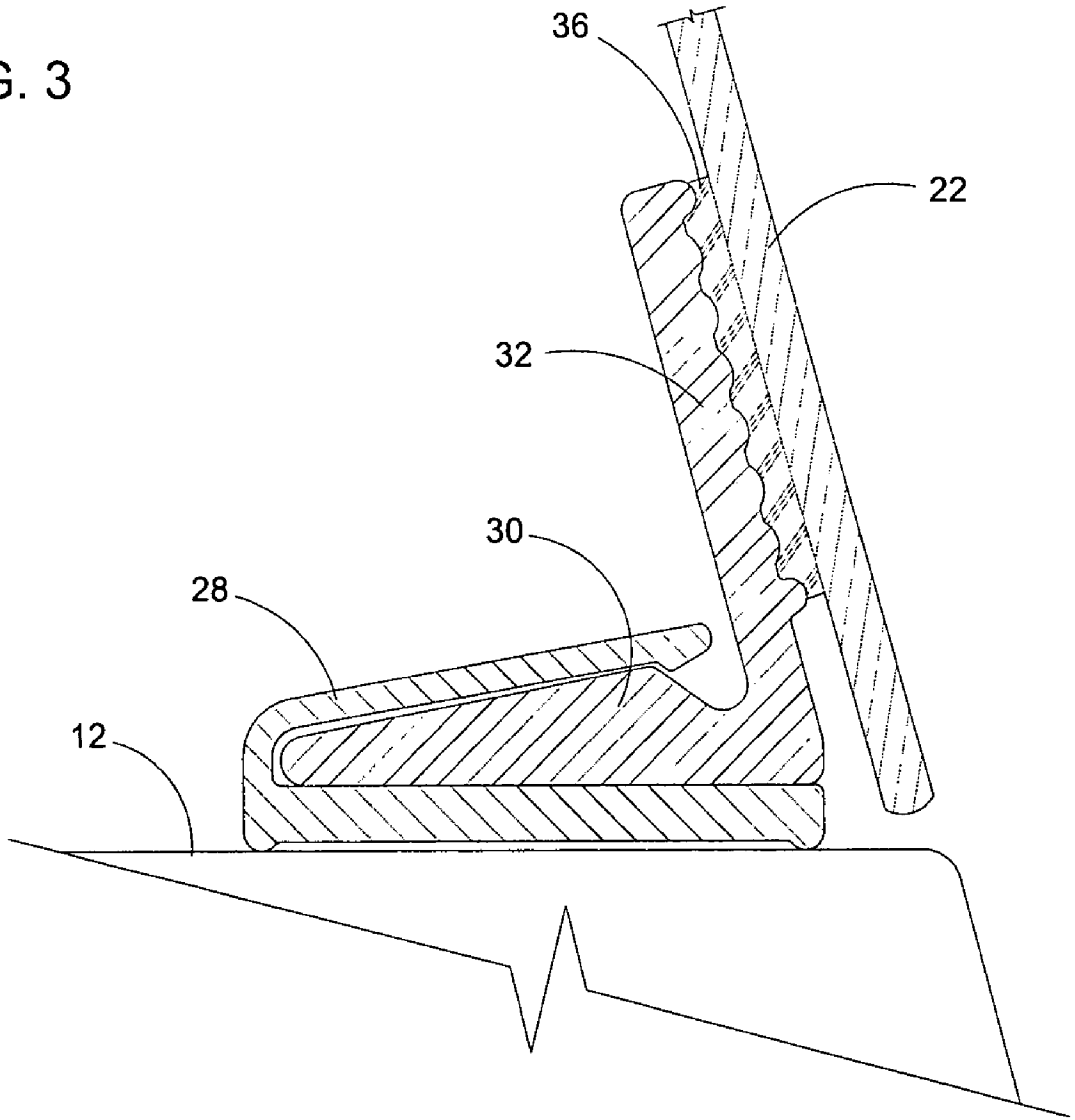
FIG. 3 is a partial sectional view of the base member and the windshield mounting rail mounted on a boat deck taken along line A from FIG. 1.

As best seen in FIG. 3 in a partial cross sectional view taken along line A from FIG. 1, of the base mounting system of the present invention, an elongated base member 28 is shown interlocked with a windshield mounting rail 30 and where the base member 28 is fastened to deck 12. The windshield mounting rail 30 includes an elongated windshield glass support element 32. Also shown in this cross sectional view is windshield glass 22 and windshield adhesive 36.

Figure 4:
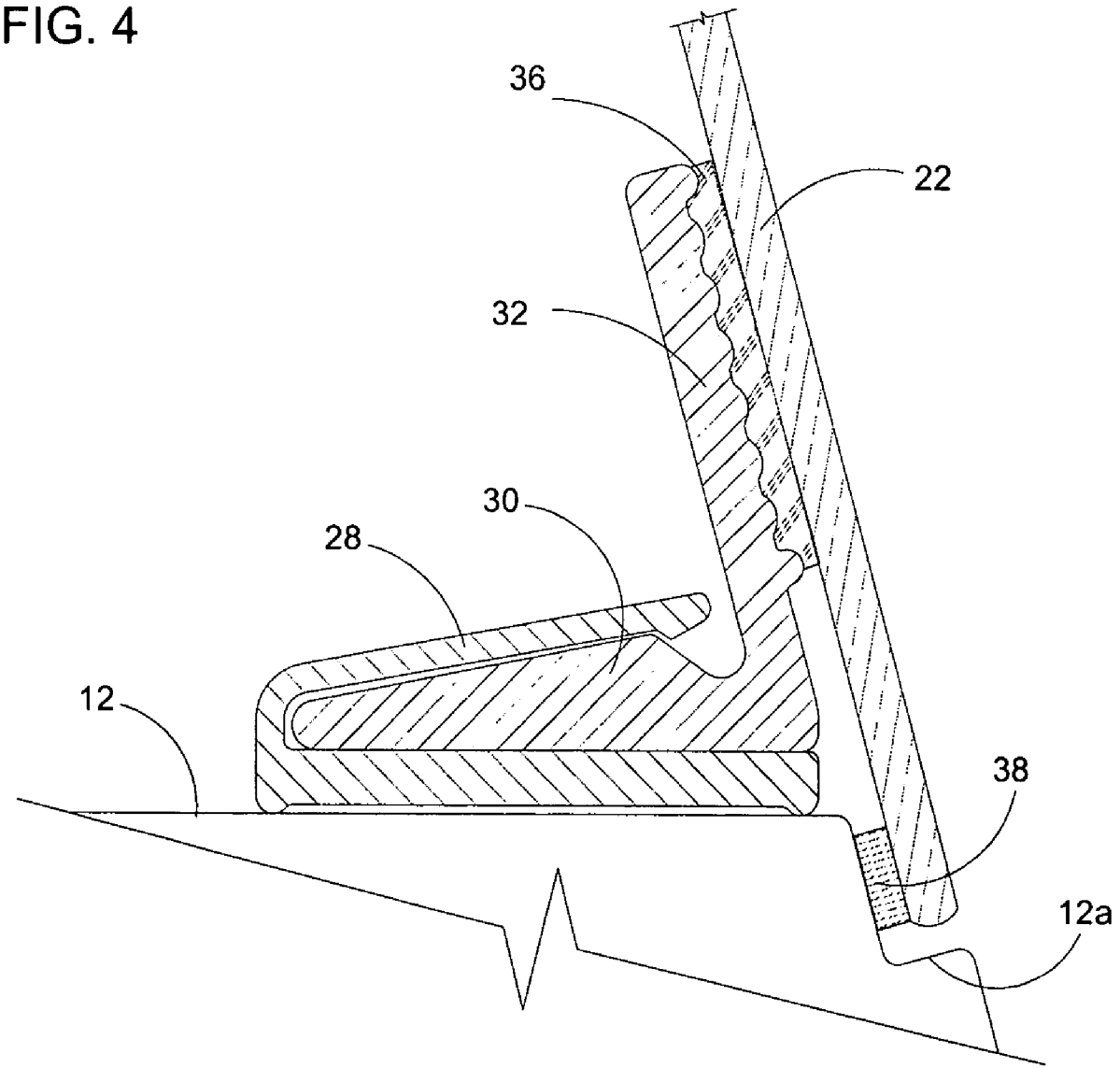
FIG. 4 is a partial sectional view of the base member and the windshield mounting rail mounted on a boat deck with a step in the boat deck.

In FIG. 4 also shown in a partial cross sectional view of the base mounting extrusion system the base member 28 and the windshield mounting rail 30, are shown mounted on deck 12, where deck 12 has a windshield transition step 12*a*, where transition step 12*a* allows glass 22 to set into deck 12. Also shown in this configuration is a strip of foam adhesive 38, where foam adhesive 38 would act as an ant-rattle preventative.

Figure 5A:
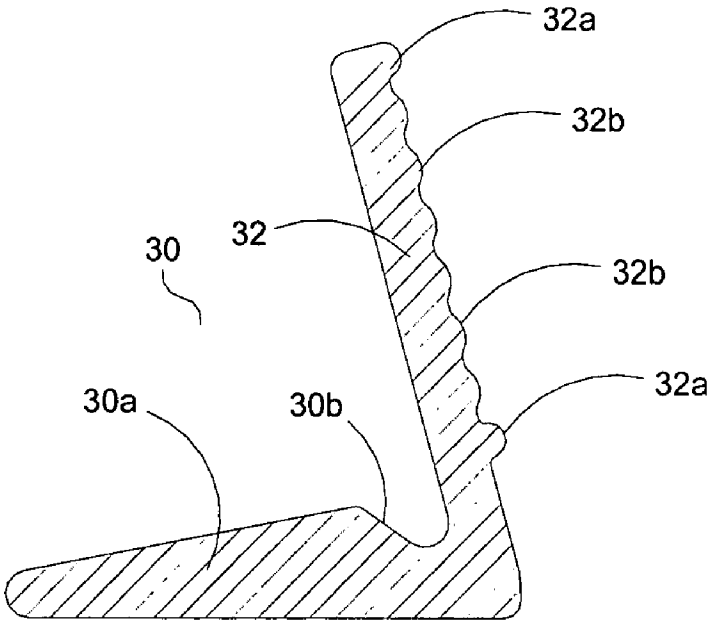
FIGS. 5*a* and 5*b* are sectional views of the base member and the windshield mounting rail separated.

As seen in FIG. 5*a* in a cross sectional view of windshield mounting rail extrusion 30, where windshield mounting rail extrusion 30 is shown separated from base member extrusion 28. Windshield mounting rail extrusion 30 has a windshield glass adhesion flange 32, where glass adhesion flange 32 can be clearly seen here as having ribs 32*a* and 32*b* thereon the glass adhesion area. Where ribs 32*a* and 32*b* act to extend the length of surface of the adhesion area, permitting an increased glue adhesion surface. As well, ribs 32*a* are projected or extended out slightly further so as to help contain the glue spread, as glass 22 is pressed into place on to the glass adhesion flange 32.

Windshield mounting rail extrusion 30 includes a wedged shaped element 30*a* where at the top of the wedge shaped element there is a recessed area 30*b*.

Figure 5B:
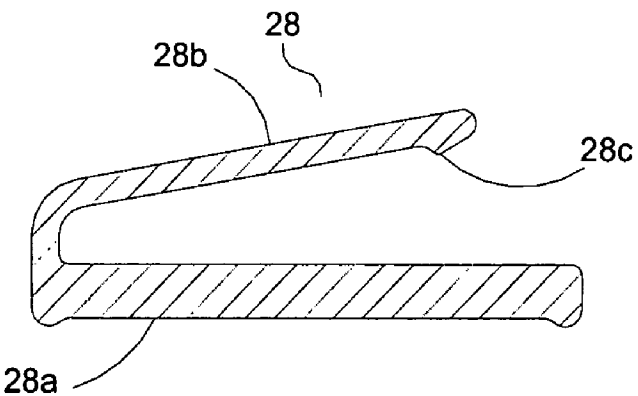

As seen in FIG. 5*b* also in a cross sectional view, base member extrusion 28 is shown separated from windshield mounting rail extrusion 30. Base member 28 has a lower surface 28*a*, which is fasten to a deck, usually using a foam tape, not shown. Base member 28 has an upper element 28*b*, where upper element 28*b* has a downward protruding lip 28*c* along and under the edge of upper element 28*b*, where the downward protruding lip 28*c* coincides with recessed area 30*c* of the windshield mounting rail 30, allowing the base member 28 to interlock with the windshield mounting rail 30 as can clearly be seen in FIG. 6*a*.

Figure 6B:
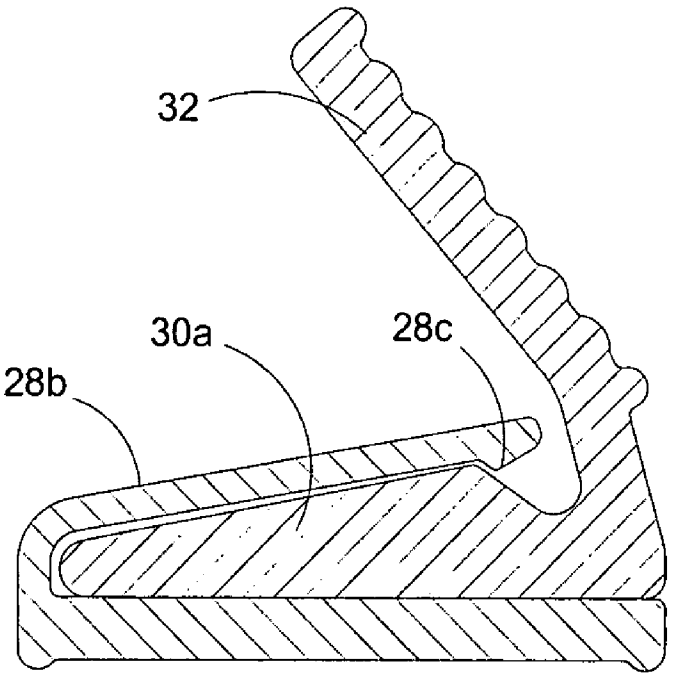
FIG. 6*b* is a sectional view of the base member together with the windshield mounting rail having been bent back after forming.
Figure 6A:
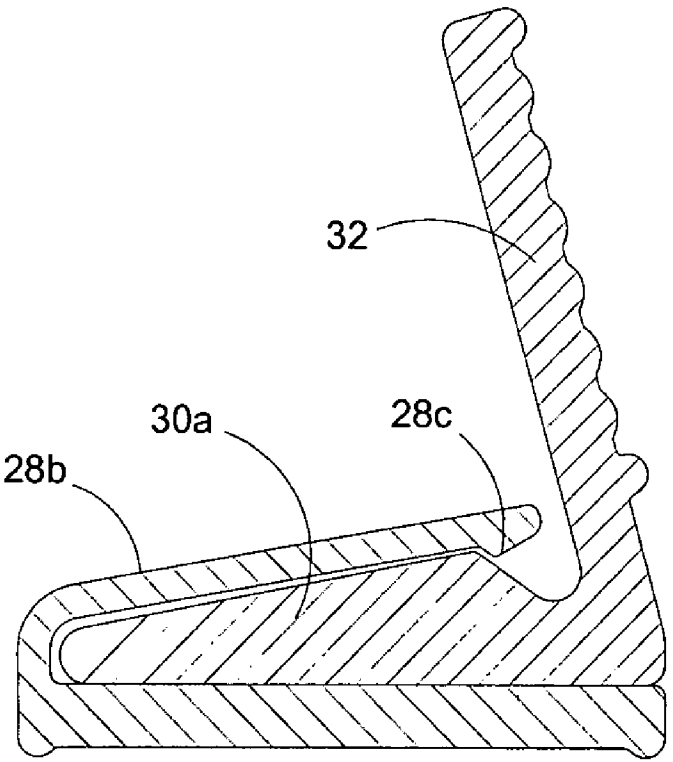
FIG. 6*a* is a sectional view of the base member and the windshield mounting rail together.

As seen in FIG. 6*b* in a cross sectional view the base member 28 and windshield mounting rail 30 together with the windshield mounting rail having been bent back after forming to conform to the windshield glass curvature.

Figure 7A:
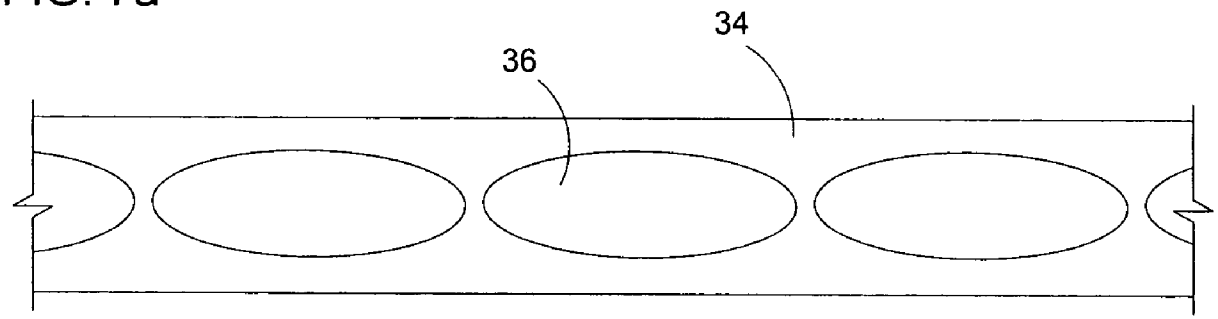
FIGS. 7*a*, 7*b* and 7*c* show sections of adhesive for mounting the windshield mounting rail to windshield glass.

As seen in FIG. 7*a*, a mode of adhesive application is shown, in this process one adhesive strip 34 having a series of spaced apertures 36, where a gel adhesive would be placed.

Figure 7B:
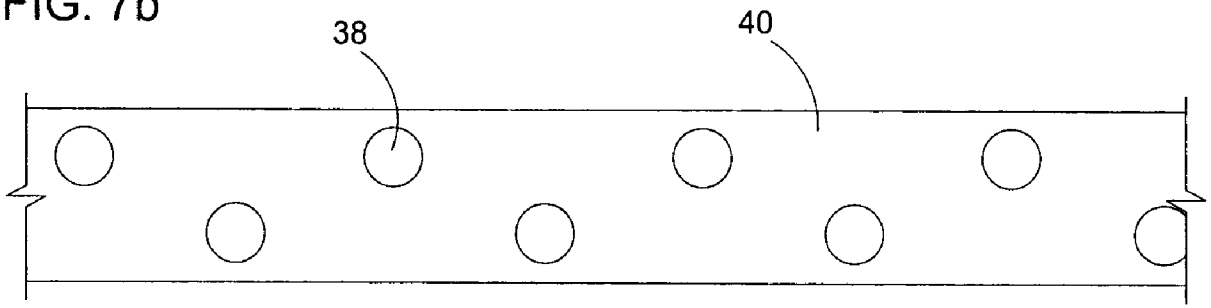

As seen in FIG. 7*b* a second mode of adhesive application is shown that resembles the opposite of the previous method, where this application process uses adhesive tabs 38 along with a gel glue ribbon 40.

Figure 7C:
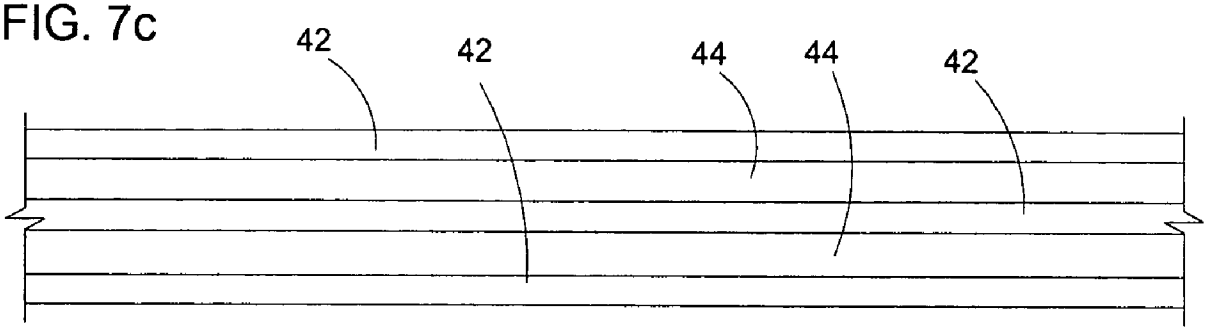

As seen in FIG. 7*c* a third mode of adhesive application is shown where this application process uses adhesive strips 42 with a gel glue 44 therebetween.

Figure 8A:
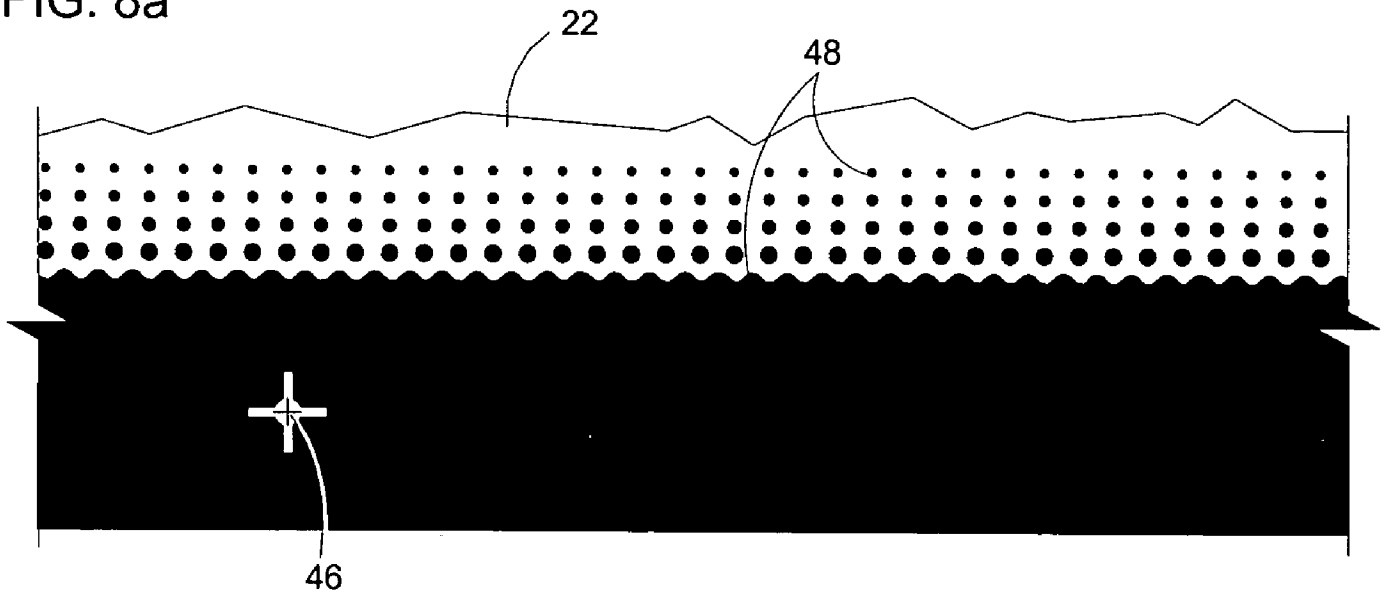
FIGS. 8*a* and 8*b* show sections of windshield glass and the windshield mounting rail, showing the alignment markings.
Figure 8B:
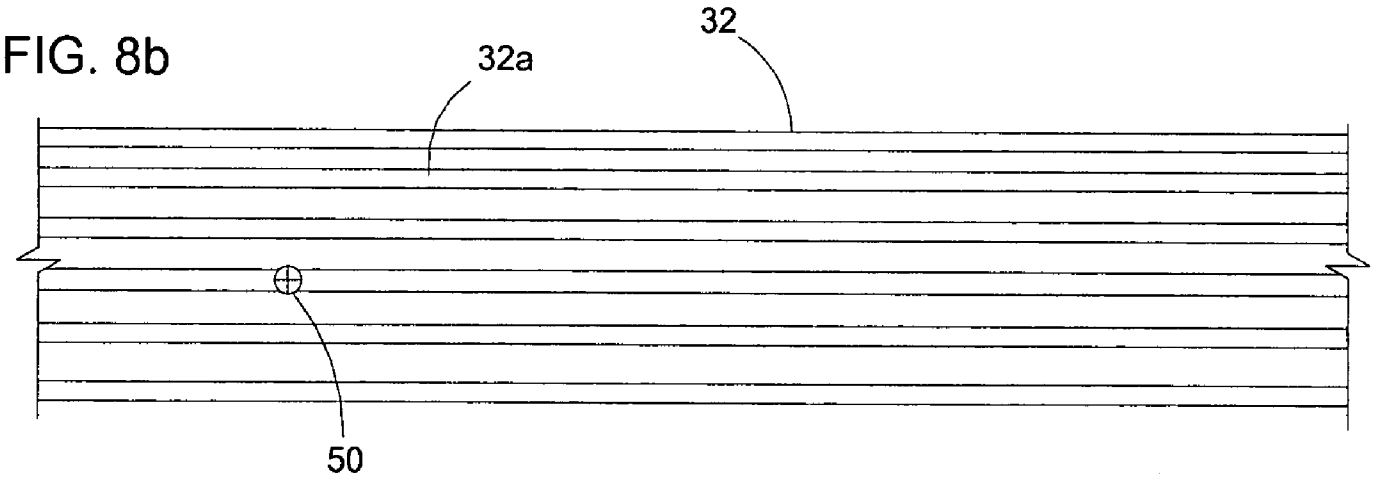

As seen in FIGS. 8*a* and 8*b*, the process of aligning the windshield glass 22 onto the windshield mounting rail 30 is shown, where a marker 46 which is on the glass coating 48, must be precisely aligned with a home marker point 50. There are a number of markers 46 on glass coating 48 and there are the same number of coinciding home marker points 50 on the windshield mounting rail flange 32.

Figure 9B:
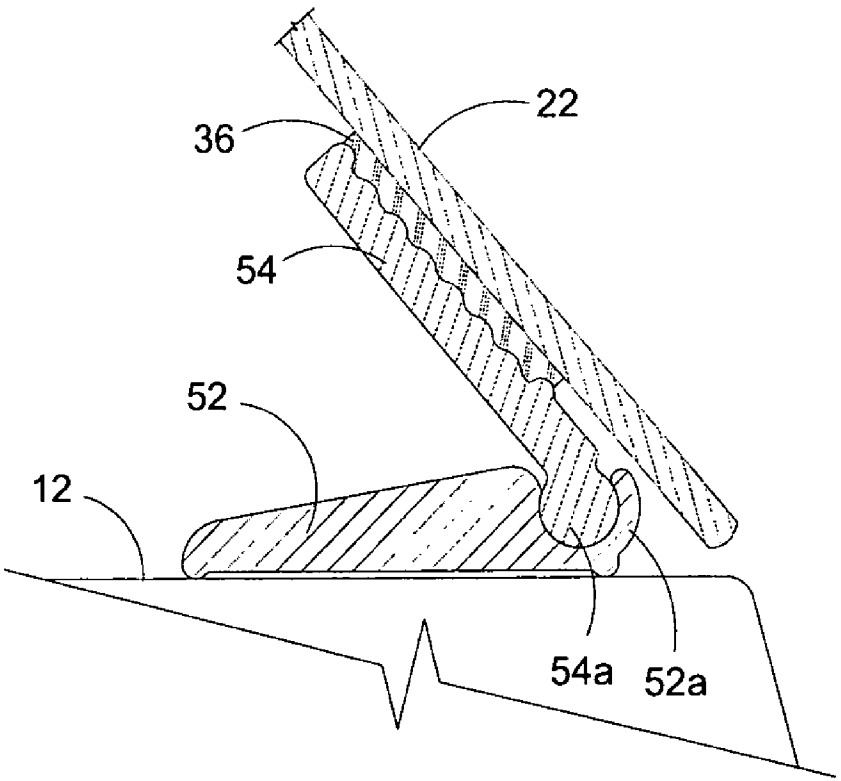
FIGS. 9*a* and 9*b* is a partial sectional view of and alternate base mounting member and windshield mounting rail, mounted on a boat deck.
Figure 9A:
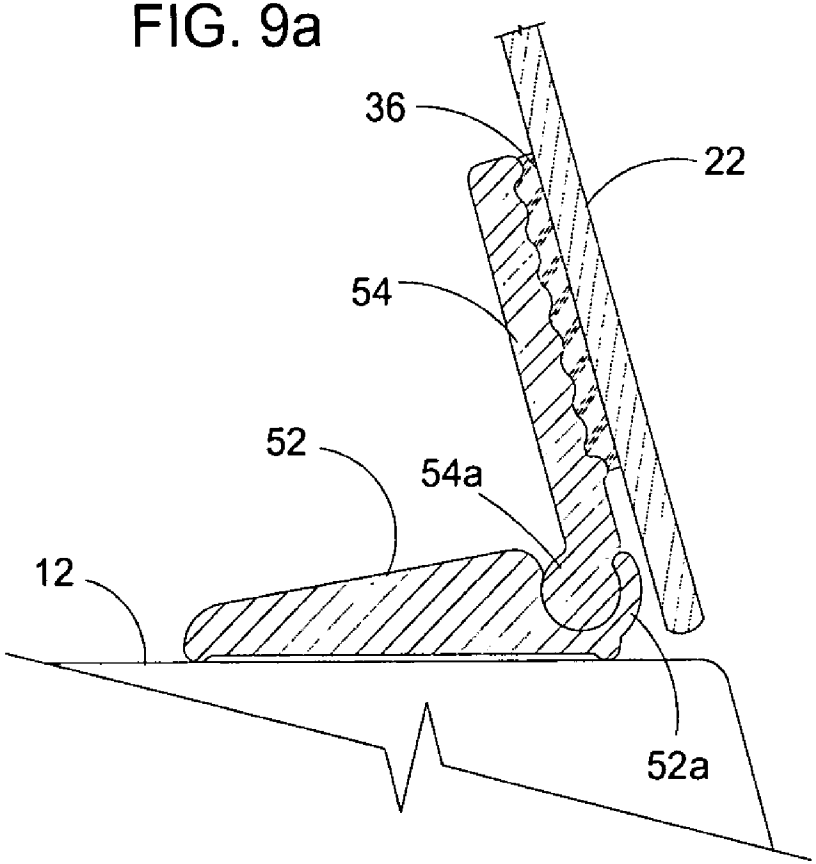

As seen in FIGS. 9*a* and 9*b*, a partial cross sectional view of and alternate mounting system is shown with a base member 52 mounted on boat deck 12. Were base member 52 has a socket 52*a* to receive a windshield glass receiving member 54, where windshield glass receiving member 54 has a rounded tab 54*a*, where rounded tab 54*a* cooperatively interlocks with socket 52*a* on base member 52.

The method and apparatus of the present invention, therefore, produce a curved windshield mounting assembly having many aesthetic and installation advantages as compared to currently employed mounting systems.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. These modifications may include forming the base members separately and reversing male and female members. The embodiments were chosen and described in order to best explain the principles of the invention and its practical application, to thereby enable others skilled in the art to best utilize the invention and various embodiments with various modifications as are suited to the particular use contemplated.

It is intended that the scope of the invention be defined by the Claims appended hereto and their equivalents.

What is claimed is:

1. A hidden marine windshield mounting system for fitting a curved windshield to a boat deck, the mounting system comprising:

an elongate base member and a windshield mounting rail, said base member longitudinally extending around the front of and mountable to the boat deck, said base member for interlocked mating with said windshield mounting rail along the length of said base member, said windshield mounting rail having a curvilinear windshield sunporting flange, said supporting flange substantially planar in vertical cross section so as to conformably mate an exterior surface of said supporting flange to an inside surface of the windshield, wherein, said windshield has an opaque coating hiding an adhesive, and said opaque coating is ceramic and applied during said windshield manufacture.

2. The mounting system as defined in claim 1, wherein said opaque coating on said windshield lower surface has alignment markers, where said alignment markers align with home markers on said windshield mounting rail said supporting flange.

3. A method of manufacturing a hidden marine windshield mounting system for mounting a curved windshield to a boat deck, comprising the steps of:

a) forming a longitudinally extending base member and forming a longitudinally extending windshield mounting rail having a windshield supporting flange;

b) applying adhesive to said windshield supporting flange;

c) aligning said windshield with said windshield supporting flange;

d) precisely setting said windshield with said supporting flange;

e) mounting said base member and said mounting rail to the boat deck so as to dispose said windshield supporting flange outboard of said base member and completely inboard of said windshield mounted thereon, wherein said windshield has an opaque coating on said windshield lower surface and wherein said opaque coating has alignment markers.

4. The method as defined in claim 3 wherein said windshield mounting rail has home markers on said supporting flange and where said windshield alignment markers are aligned with said home markers so to precisely align and set the position of said windshield with said windshield mounting rail.

5. The method as defined in claim 3, further comprising linearly adjusting said windshield mounting rail relative to said elongated base member for adjusting said windshield after a boat hull associated with the boat deck settles over prolonged service.

6. A marine windshield mounting system for fitting a curved windshield to a boat deck of a boat, the mounting system comprising:

an elongate base member and a windshield mounting rail, said base member mountable to the boat deck, said base member for interlocked mating with said windshield mounting rail along the length of said base member, said base member having upper and lower flanges extending said length of said base member and defining a cavity extending substantially said length of said base member, said base member adapted for mounting to the boat deck so that said cavity opens outboard relative to a center of the boat when said base member is mounted to the boat deck, said windshield mounting rail consisting of a lower male member for mounting into said cavity and adapted to fit snugly in mating engagement into said cavity when so mounted, and a curvilinear windshield supporting flange, said supporting flange substantially planar in vertical cross section so as to conformably mate an exterior surface of said supporting flange to an inside surface of the windshield, wherein said male member and said supporting flange are cantilevered one from the other so as to form an acute angle therebetween, wherein when said male member is mounted into said cavity, said supporting flange extends upwardly from said male member and said base member so that when said base member is mounted onto the boat deck, and said male member is mounted into said base member, and said windshield is mounted onto said supporting flange, said base member and said windshield mounting rail are completely inboard of the windshield and not directly exposed outboard.

7. The mounting system of claim 6 wherein said base member is resilient whereby said windshield mounting rail may be de-mounted from said cavity.

8. The mounting system of claim 6 wherein said base member and said windshield mounting rail are aluminium extrusions.

9. The mounting system of claim 6 wherein said base member is adapted so as to be selectively de-mountable from the boat deck for replacement of the windshield.

10. The mounting system of claim 6 wherein said windshield supporting flange includes an elongate ribbed surface on said outer surface so as to provide an adhesive contact surface of increased area.

11. The mounting system of claim 10 wherein said ribbed surface includes elongated and protruding ribs protruding from said outer surface beyond the remaining ribs of said rib surface to control spread of an adhesive between said outer surface and the windshield when the windshield is mounted to said windshield supporting flange.

12. The mounting system of claim 11 wherein said adhesive includes a combination of gel and flexible strip adhesive.

13. The mounting system of claim 11 wherein said adhesive is a urethane based adhesive.

14. The mounting system of claim 11 further comprising an opaque coating applied to the windshield so as to hide said adhesive.

15. The mounting system of claim 14 wherein said opaque coating is ceramic.

16. The mounting system of claim 6 further comprising tinting applied to said windshield to hide said base member and said windshield mounting rail when the windshield is mounted to said windshield supporting flange.

17. The mounting system of claim 6 wherein said base member and said windshield mounting rail are adapted for mounting into a step in the boat deck.

18. The mounting system of claim 6 wherein said base member and said windshield mounting rail are adapted for use with a curved windshield.

19. The mounting system of claim 18 wherein said base member and said windshield mounting rail are adapted for mounting a sectional curved windshield.

20. The mounting system of claim 6 wherein said male member of said windshield mounting rail includes a wedge for insertion into said cavity and wherein said cavity is shaped for snug mating with said wedge.

21. The mounting system of claim 20 further comprising a latch means for latching said base member onto said windshield mounting rail for releasably lockable mounting of said male member into said cavity.

22. The mounting system of claim 6 wherein said cavity in said base member is an elongate rounded socket, and wherein said male member of said windshield mounting rail is a rounded bead for snug mating into said socket.

23. A marine windshield mounting system for fitting a curved windshield to a boat deck of a boat, the mounting system comprising:

an elongate base member and a windshield mounting rail mounted thereto, said base member longitudinally extending around the front of and mountable to the boat deck, said rail having a curvilinear windshield supporting flange, said supporting flange substantially planar in vertical cross section so as to conformably mate an exterior surface of said supporting flange to an inside surface of the windshield, wherein said elongate base member and said supporting flange are cantilevered one from the other so as to form an acute angle therebetween, wherein when said base member is mounted onto the boat deck said supporting flange extends upwardly from said base member so that when said base member is mounted onto the boat deck, and said windshield is mounted onto said supporting flange, said base member and said windshield mounting rail are completely inboard of the windshield and not directly exposed outboard.

* * * * *